US007160029B2

(12) United States Patent
Bein et al.

(10) Patent No.: US 7,160,029 B2
(45) Date of Patent: Jan. 9, 2007

(54) ENCLOSURE FOR RESEALING A PACKAGE AND METHOD THEREFOR

(75) Inventors: Denise A. Bein, Phoenix, AZ (US); Jeffrey P. Bein, Phoenix, AZ (US)

(73) Assignee: Inventor Mom LLC, Phoenix, AZ (US)

( * ) Notice: Subject to any disclaimer, the term of this patent is extended or adjusted under 35 U.S.C. 154(b) by 0 days.

(21) Appl. No.: 11/021,421

(22) Filed: Dec. 23, 2004

(65) Prior Publication Data

US 2006/0137997 A1 Jun. 29, 2006

(51) Int. Cl.
*B65D 33/16* (2006.01)
*B65D 73/00* (2006.01)

(52) U.S. Cl. ..... 383/67; 206/494; 220/694; 493/264

(58) Field of Classification Search ..... 206/527, 206/494, 812; 215/2, 6, 386; 220/601, 694, 220/729, 730; 383/64, 67, 78, 81, 127, 203, 383/28; 493/186, 264
See application file for complete search history.

(56) References Cited

U.S. PATENT DOCUMENTS 4,101,026 A * 7/1978 Bonk ..... 206/812
4,691,373 A 9/1987 Ausnit
4,765,381 A * 8/1988 Castle ..... 383/67
5,067,821 A * 11/1991 Young ..... 383/36
5,211,482 A 5/1993 Tilman
5,749,658 A * 5/1998 Kettner ..... 383/65
5,758,936 A 6/1998 Baughan
5,827,163 A * 10/1998 Kettner ..... 493/211
6,186,663 B1 * 2/2001 Ausnit ..... 383/64

* cited by examiner

*Primary Examiner*—Luan K. Bui
(74) *Attorney, Agent, or Firm*—Snell & Wilmer L.L.P.

(57) ABSTRACT

An enclosure is provided for resealing a package. A body of formable material has an open end and a closeable end. The body may have slits on opposite sides for expanding the open end. An adhesive strip is provided on the open end of the body for securing to the package. The adhesive strips extend beyond the slits in the body for securing the first side of the body to the second side of the body. A closing mechanism is provided on the closeable end of the body. The closing mechanism has a lip and groove along the closeable end, and a locking mechanism for inserting the lip into the groove to reseal the enclosure. The closing mechanism slides across the closeable end of the enclosure to allow the enclosure to be opened and closed. The enclosure may have a spout formed in the closeable end of the enclosure.

6 Claims, 7 Drawing Sheets

ENCLOSURE FOR RESEALING A PACKAGE AND METHOD THEREFOR

FIELD OF THE INVENTION

The present invention relates in general to enclosures for resealing packages and, more particularly, to an enclosure having an open end for attaching to an opened end of a package and having a closeable end for resealing the package.

BACKGROUND OF THE INVENTION

Many foods and staples are conveniently packaged in plastic bags. The packaged items are sold in grocery stores, convenience stores, and other retail outlets. One can purchase dried pasta, rice, flour, and other pantry items in a sealed package. Other products which are sold in sealed packages include pet food, kitty litter, household supplies, construction supplies (tile grout), and medical supplies. When the package is opened, typically only a small portion of its contents is used at any one time. In the case of packaged rice, the sealed package can be opened by cutting or pulling apart one end. The desired quantity is poured from the package. However, most packages are not resealable. Thus the problem arises as to what to do with the remaining contents of the opened package.

In some cases, the user may decide to pour the remainder of the package into a storage container, e.g., glass jar. With the large number of individual staple items, each being opened at one time or another, the user must invest in a correspondingly large number of glass jars and dedicate storage space for each. There may be a white rice glass jar, a brown rice glass jar, a whole grain rice glass jar, a long grain rice glass jar, etc. The number of storage containers quickly becomes unwieldy, expensive, and difficult to find places for in the average kitchen.

For most opened packages, consumers resign themselves to folding over the opened end and then maybe placing a rubber band around the package to hold the opened flap down. The make-shift resealed package is placed back in the cupboard. Unfortunately, once opened, the contents of the package become subject to spoilage, drying out, insect infestation, and inability to transport. The rubber band around the folded-over flap is by no means air tight and moisture tight. Sometimes the rubber band is left off by accident, oversight, or it may break. In any case, the shelf life of package foods is dramatically reduced once the package is opened. The opened package is subject to accidental spillage and spoilage over time. The opened package becomes difficult to transport, e.g., any non-perishable product bought while on vacation is difficult to bring home without spillage. The consumer ends up wasting money from failure to utilize the entire contents of the package of many products.

Some products are purchased in open packages. Warm food purchased from the restaurant is often placed in a bag or package for transport home. The open bag allows heat to escape, even when folded over, and diminishes the quality of the food by the time the consumer reaches home.

A need exists for an apparatus and method of sealing or resealing opened bags and packages.

SUMMARY OF THE INVENTION

In one embodiment, the present invention is an enclosure for resealing a package comprising a body of formable material having an open end and a closeable end. An adhesive strip is disposed on the open end of the body of formable material. The adhesive strip is adapted for securing to the package. A resealing mechanism is disposed on the closeable end of the body of formable material for resealing the package.

In another embodiment, the present invention is an enclosure for resealing a package comprising a body having an open end and a closeable end. A sealing mechanism is disposed on the open end of the body for contacting around the perimeter of the package. A closing mechanism is disposed on the closeable end of the body for closing the enclosure.

In another embodiment, the present invention is a method of making an enclosure for resealing a package comprising providing a body having an open end and a closeable end, providing a sealing mechanism along the open end of the body for contacting around the perimeter of the package, and providing a closure mechanism on the closeable end of the body for closing the enclosure.

In another embodiment, the present invention is an apparatus for sealing a package comprising an enclosure having an open end and a closeable end. An adhesive strip is disposed on the open end of the enclosure. A closing mechanism is disposed on the closeable end of the enclosure.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
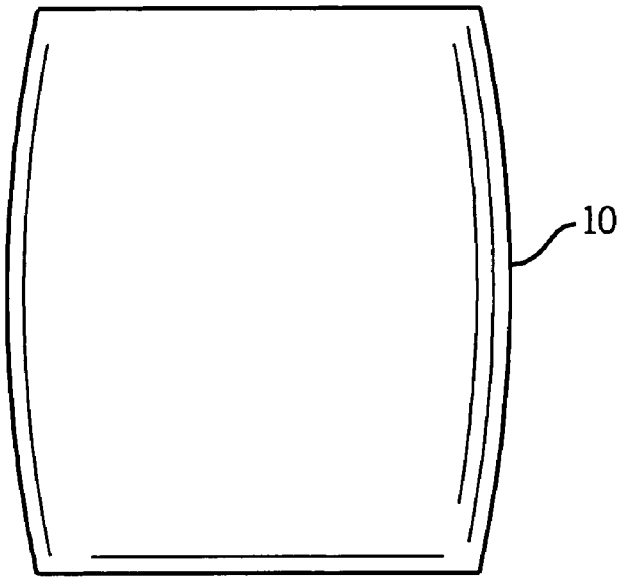
FIG. 1 illustrates a package for containing product or material.

A package or bag 10 is shown in FIG. 1 for containing a product or material. In the present embodiment, package 10 contains a liquid or food item such as rice, flour, cereal, or deli meat. In other embodiment, package 10 may contain freezer items, household items, construction materials, and the like.

Figure 2:
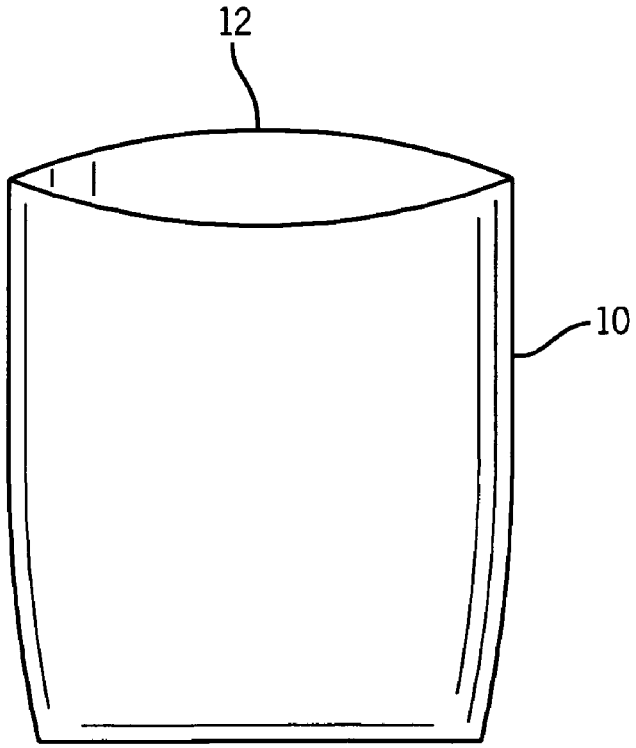
FIG. 2 illustrates the package in an opened condition.

During the original manufacturing process, package 10 is sealed to contain the product or material. Package 10 is generally air and moisture tight when purchased by the consumer or end user. To use the product, the consumer opens package 10, typically on one end or the other, or cuts off a corner, and then pours out the desired quantity of the product. FIG. 2 shows package 10 with end 12 in an opened condition. Other packages may be opened on the bottom, top, or side, e.g., tissue paper dispenser. The above-mentioned problem then arises as what to do with the remaining contents of package 10.

Figure 3:
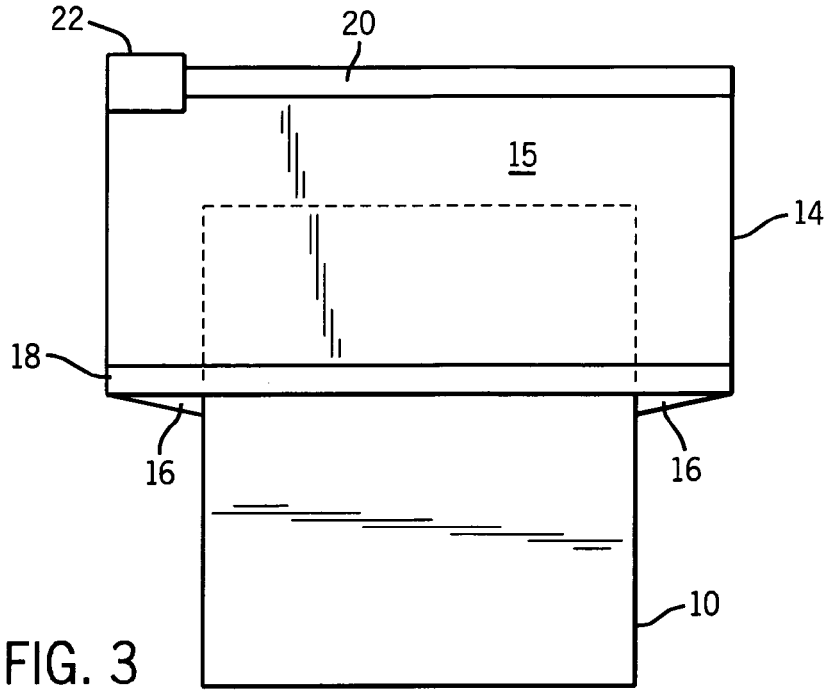
FIG. 3 illustrates a resealable enclosure positioned over the opened package.

Turning to FIG. 3, enclosure 14 is provided to seal or reseal open end 12 of package 10. The seal or reseal is not necessarily air or water tight, but is designed to keep the contents of package 10 inside and most contaminants and contaminating influences outside. Enclosure 14 has a main body 15 made of formable plastic material, e.g., similar to the material of package 10. That is, the main body of enclosure 14 is typically larger than package 10 and has the ability to conform to the size and shape of package 10. Enclosure 14 has an opening 16 with adhesive strip 18 disposed around opening 16. A protective tape or covering is disposed over adhesive strip 18 to keep the adhesive clean and tacky until ready for use. Opening 16 of enclosure 14 slides over package 10. Opening 16 is adapted to fit around and conform to many different shapes and sizes of package 10 and will seal even when enclosure 14 is larger than package 10.

To affix enclosure 14 to package 10, the protective tape is removed from adhesive strip 18 so it is ready to secure to a surface of package 10. Opening 16 of enclosure 14 is slid over opening 12 of package 10 so that adhesive strip 18 is positioned over a clean and undamaged portion of package 10. In other words, opening 16 should be moved far enough down package 10, past opening 12, so that adhesive strip 18 will secure to a clean and damage-free portion of package 10. At the same time, the user must leave sufficient room or slack on the top side of enclosure 14 to readily open and close the package. Adhesive strip 18 is pressed against a surface of package 10 to form, in some cases, an air tight and moisture tight seal. The portion of adhesive strip 18 that is outside of the form factor of package 10 is sealed against itself on opposite sides of opening 16. Opening 16 of enclosure 14 thus conforms to package 10 and is completely sealed with adhesive strip 18.

Enclosure 14 further includes a resealable end 20 having a resealing feature such as a slideable locking mechanism 22. Once opening 16 is sealed to an outside surface of package 10, slideable locking mechanism 22 can be used to open and close resealable end 20 of enclosure 14. To close package 10, slideable locking mechanism 22 is traversed one direction across resealable end 20. Resealable end 20 has a lip and groove across its length. The lip is inserted into the groove to provide a substantially air tight and moisture tight seal. The locking mechanism presses the lip into the groove across the length of resealable end 20 to form the substantial air tight and moisture tight seal. To open package 10, slideable locking mechanism 22 is traversed the opposite direction across resealable end 20. The locking mechanism pulls the lip from the groove across the length of resealable end 20. Package 10 is then open ready to dispense its contents.

Resealable end 20 can be resealed using several different mechanical locking structures. The consumer can press the lip and groove together across resealable end 20 using their thumb and index finger. In another embodiment, resealable end 20 can be secured with an adhesive that can be attached and detached with sufficient pressure. In another embodiment, the open end of enclosure 14 can be secured with magnetic strips. Two magnetic strips are positioned one on each side of enclosure 14. When the two magnetic strips are brought together, the magnetic attraction seals package 10. In yet another embodiment, resealable end 20 may use Velcro strip to reseal package 10. In yet another embodiment, resealable end 20 is sealed with a heat seal or permanent adhesive. In this latter case, enclosure 14 may be able to reseal package 10 only once.

Enclosure 14 provides the ability to reseal packages to preserve freshness and prevent spillage and spoilage. The contents of package 10 can remain stored in its original container while maintaining a tight seal. When the consumer wants to dispense a portion of the contents of package 10, the resealable end 20 is opened by sliding locking mechanism 22 in the open direction. The contents of package 10 can be dispensed. To reseal package 10, locking mechanism 22 is slid in the close direction. With enclosure 14, package 10 can be opened and closed many times to dispense the desired portion of the contents until the package is empty. During period of non-use, enclosure 14 keeps package 10 sealed against insects, humidity, dust, contaminants, spillage, and spoilage.

Enclosure 14 can be made with a variety of materials. In one embodiment, enclosure 14 is plastic, similar to the material of package 10. Alternatively, enclosure 14 can be a paper material with a protective coating or other material suitable for resealing package 10.

Figure 4:
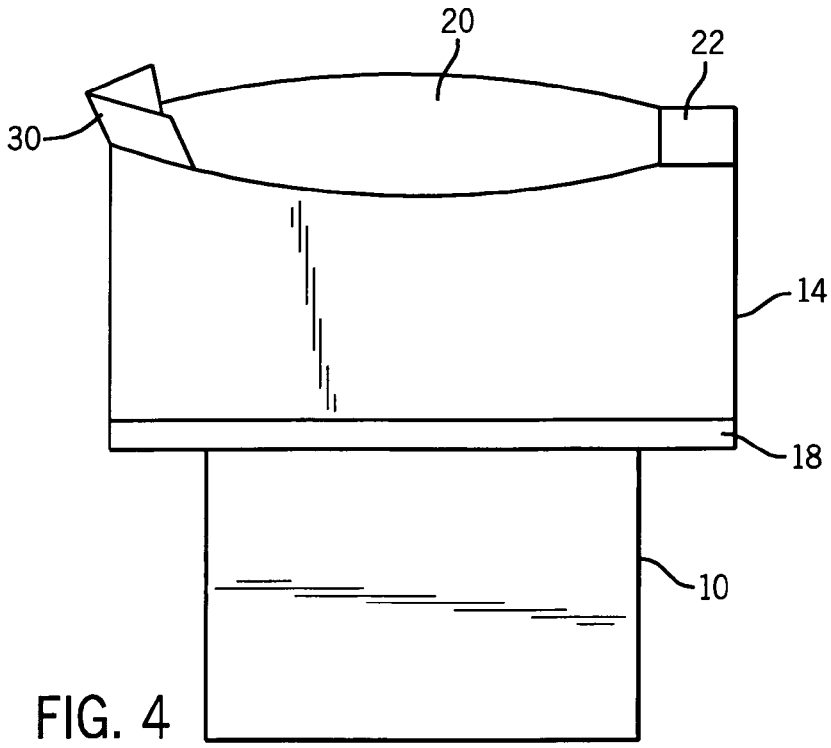
FIG. 4 illustrates the resealable enclosure with a spout.

FIG. 4 illustrates enclosure 14 with spout 30. Spout 30 is convenient for pouring the contents of package 10. Spout 30 is particularly useful when the contents of package 10 is liquid, granular, or other small pieces. Spout 30 is designed to fold to a small thickness when enclosure 14 is closed. Spout 30 opens to a beveled surface for channeling the contents of package 10 in a controllable manner to a target area when pouring.

Figure 5:
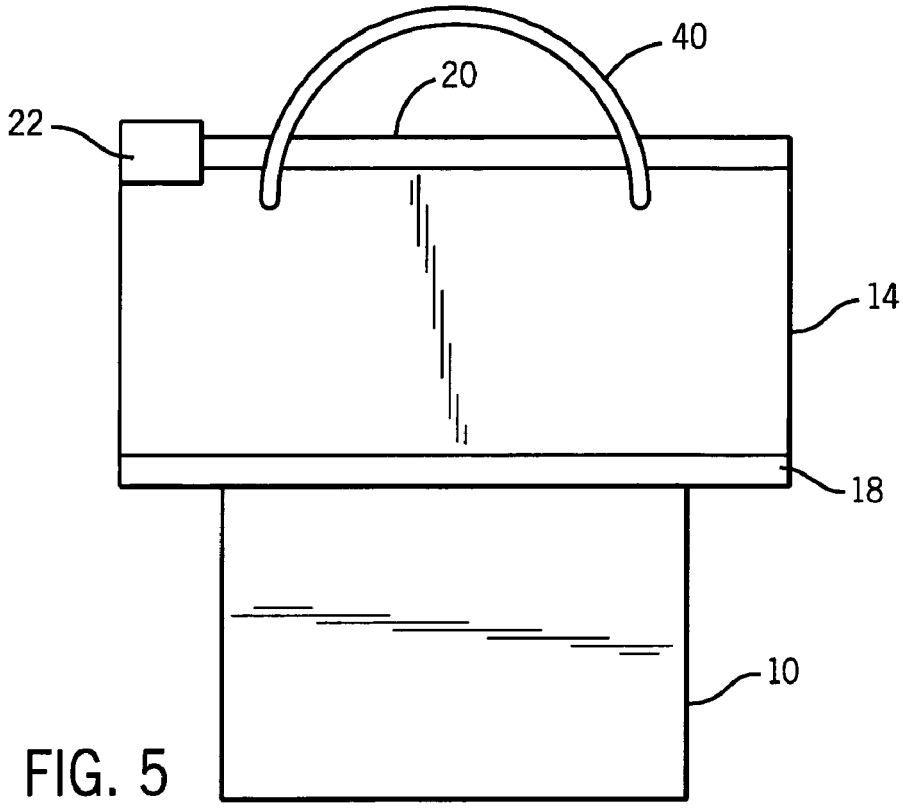
FIG. 5 illustrates the resealable enclosure with a handle.

FIG. 5 shows enclosure 14 with handle 40. Handle 40 is secured or integrated into enclosure 14 to provide a strong support for package 10. Handle 40 is convenient for carrying package 10 after it has been initially opened. The consumer will be able to carry multiple packages like 10, each with handle 40.

Enclosure 14 is adapted to reseal a variety of sizes and shapes of package 10. Package 10 may be in the form of a bag, box, bottle, bucket, can, or other container designed to hold a product or material. Package 10 may be paper, plastic, metallic, glass, etc. Package 10 may be rectangular, cylindrical, circular, oval, and the like. Package 10 may be thin, fat, solid, flexible, or other physical characteristic selected by the manufacturer to hold the contents of the package. In a few specific examples, package 10 may be a package of rice, bag of potato chips, bag of pet food, package of deli meat, wrapper of crackers, box of cereal, can of soda, bottle of wine, package of cookies, or bucket of fruit and vegetables. In each case, enclosure 14 is designed to reseal each of these sizes and shapes of containers. Enclosure 14 can be provided in a gradation of different base sizes to more conveniently match up with packages of widely varying shapes and sizes. Enclosure 14 may come in small, medium, and large sizes for economies of scale.

Figure 6:
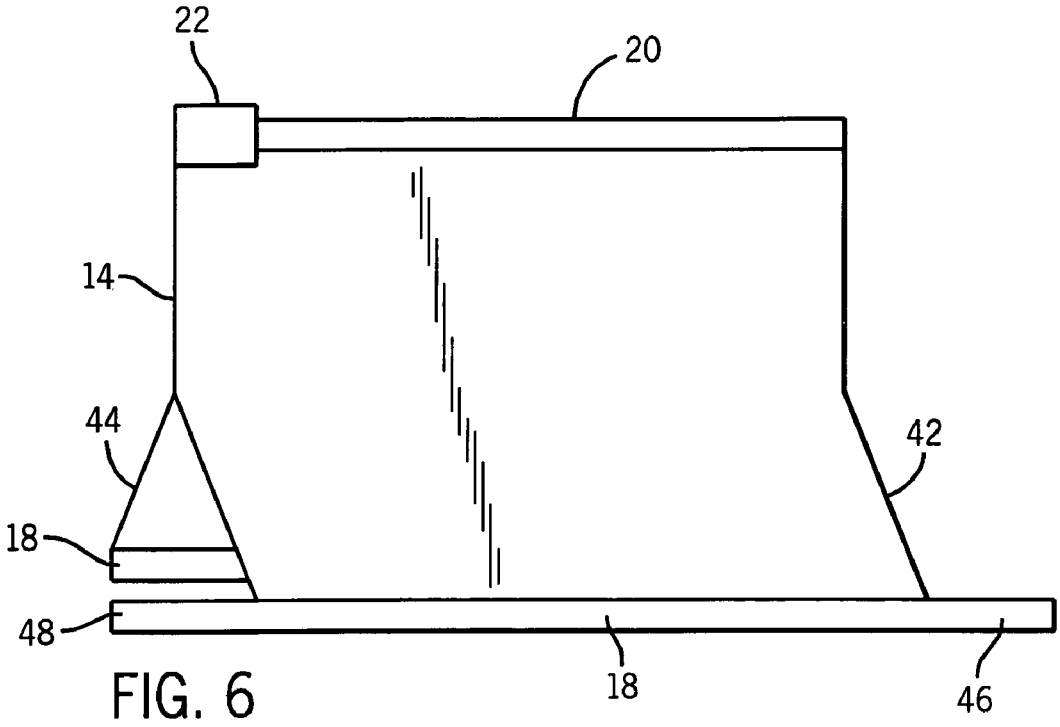
FIG. 6 illustrates the resealable enclosure with slits along the side for expanding the bottom opening.

To accommodate the different form factors of package 10, enclosure 14 may have an expandable opening. FIG. 6 illustrates slits from opening 16 up the sides of enclosure 14. The slits form a first side 42 and a second side 44 of enclosure 14 to allow the expandable opening to wrap around package 10. The adhesive strip on side 42 has adhesive extensions 46 and 48 for sealing to side 44. To use enclosure 14 with the expandable opening, package 10 is inserted into the expandable opening. Side 44 is wrapped around package 10 to form a snug fit. The adhesive strip 18 on side 44 is secured or adhered to package 10. Side 42 is folded over side 44 to maintain the snug fit. Adhesive extensions 46 and 48 on side 42 adhere to side 44 to secure enclosure 14 to package 10.

Figure 7:
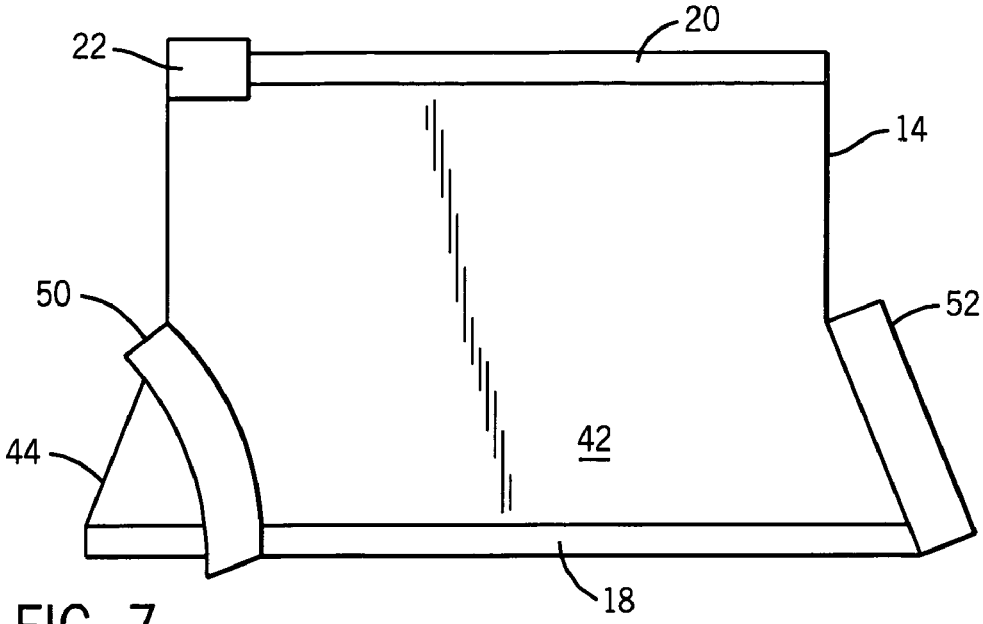
FIG. 7 illustrates extensions of the adhesive strips along the slits of the enclosure.
Figure 8:
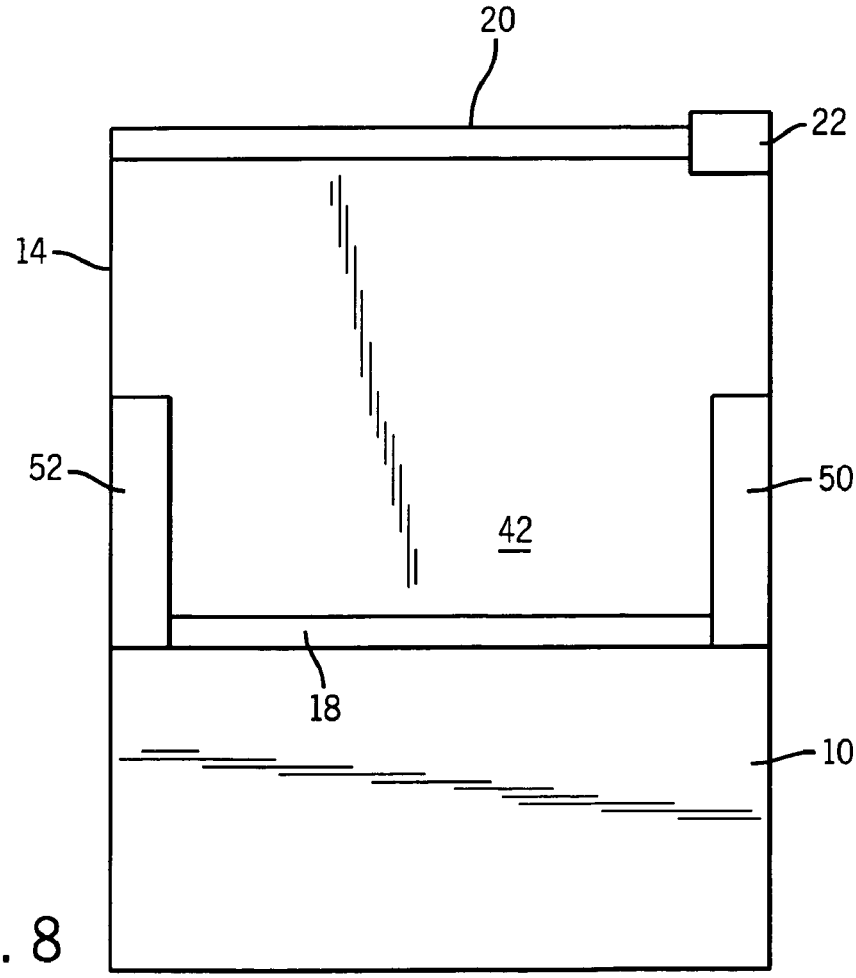
FIG. 8 illustrates the enclosure sealed to the package.

Another embodiment of enclosure 14 with the expandable opening is shown in FIG. 7. In this case, adhesive strips 50 and 52 are provided on side 42, along the length of the slits between side 42 and side 44. The adhesive strips 50 and 52 on side 42 are provided to secure to side 44, after side 42 is folded over side 44. FIG. 8 illustrates the opening 16 of enclosure 14 tightly secured to package 10. The adhesive strips 18 and adhesive strips 50 and 52 provide a seal to keep the contents of package 10 inside and in some cases form an air tight and moisture tight seal between opening 16 of enclosure 14 and package 10.

The expanded opening may also be accomplished with pleats or expandable areas in the material of enclosure 14.

Figure 9A:
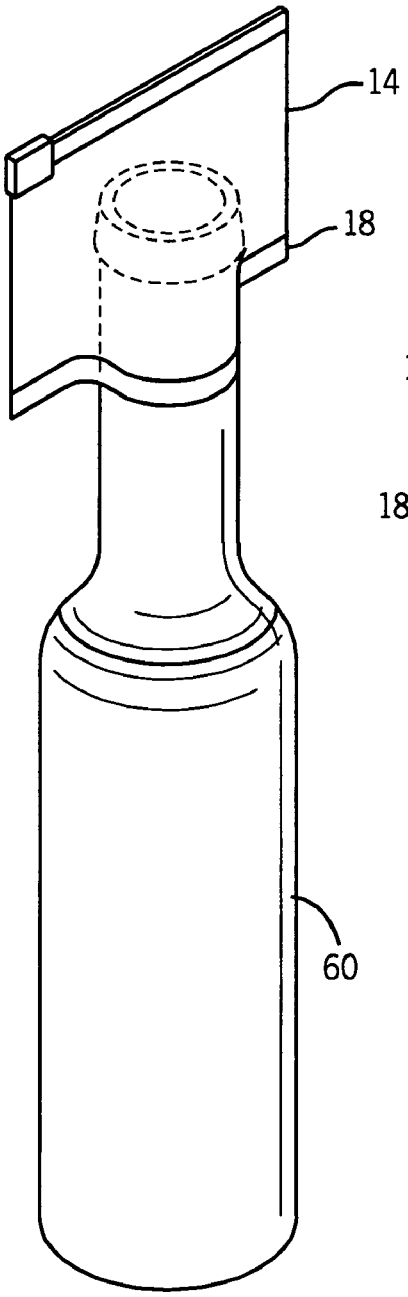
FIGS. 9*a*–9*d* illustrate the enclosure resealing a variety of package shapes and sizes.
Figure 9B:
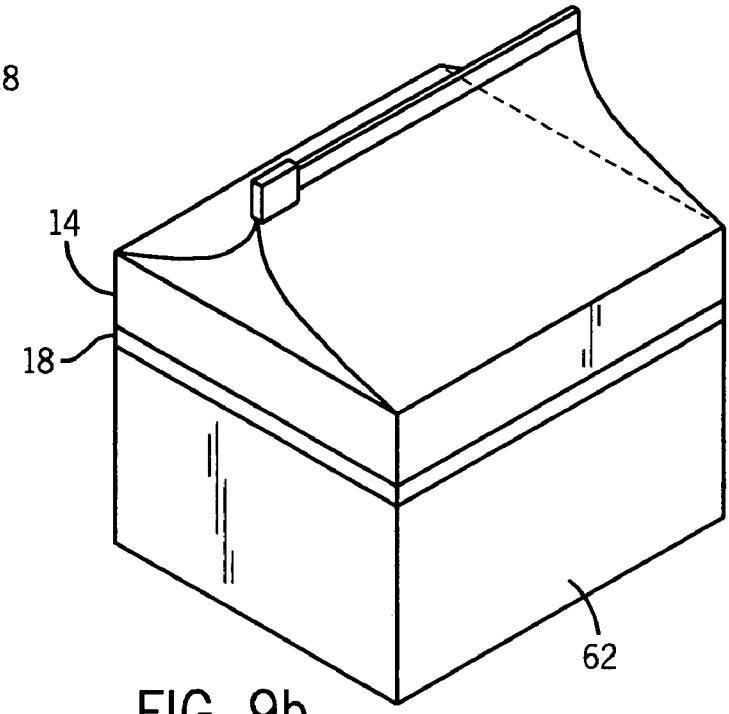
Figure 9C:
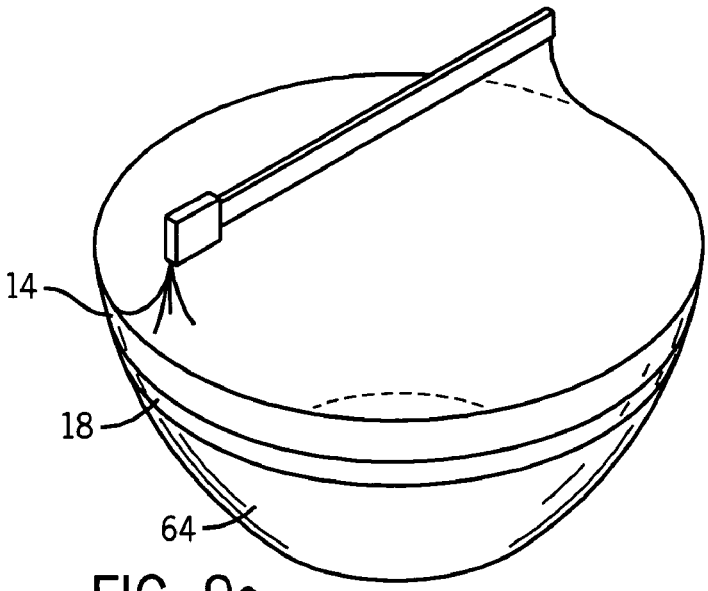
Figure 9D:
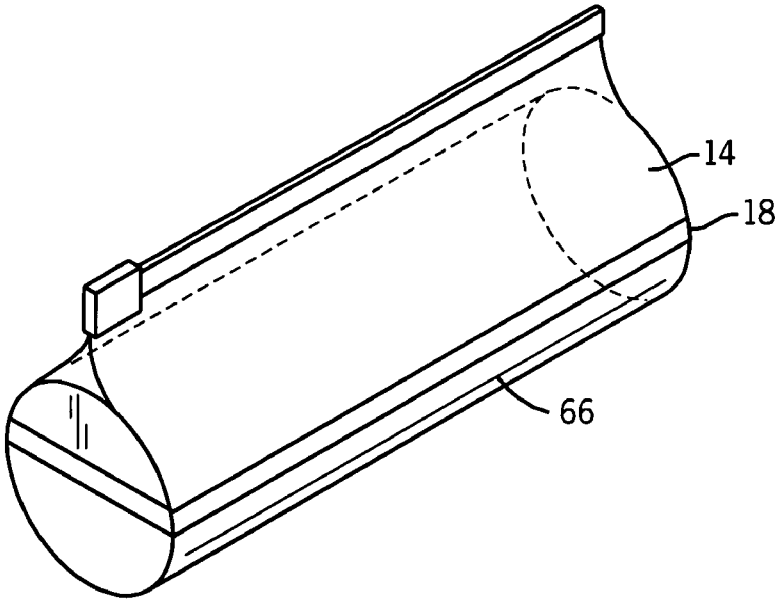

As noted above, enclosure 14 can seal and reseal many different sizes and shapes of packages. The main body of enclosure 14 can also be made rectangular, circular, triangular, or other shape to conform to a corresponding shape of opened package. FIG. 9*a* illustrates enclosure 14 sealing bottle 60. FIG. 9*b* illustrates enclosure 14 sealing box 62. FIG. 9*c* illustrates enclosure 14 sealing circular bowl 64. FIG. 9*d* illustrates enclosure 14 sealing the long side of cracker package 66.

In other embodiments, the top and bottom openings of enclosure 14 may be closed with elastic bands, tape, glue, adhesive, draw strings, tie locks, heat seal, clips, and other mechanical closures. These mechanical closures are useful to keep dust and contaminants out of the opened package. Enclosure 14 can be made from multi-ply plastics for extra strength in resealing heavy packages. The extra-strong enclosure 14 is useful for package of tile grout, concrete mix, charcoal, large bags of pet food, and the like.

Figure 10:
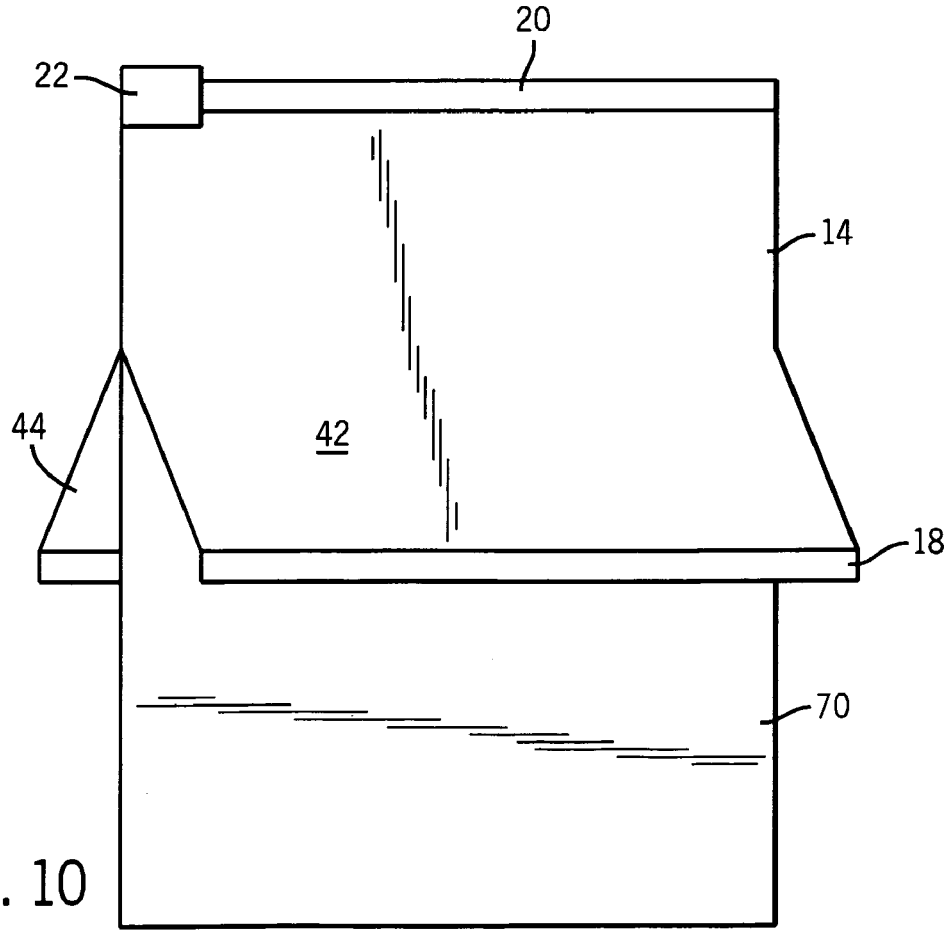
FIG. 10 illustrates a moistened towel within the enclosure.

For perishable items, such as salad greens, enclosure 14 is ideal for resealing the package after use. In this case, the seal keeps the moisture in and preserves the freshness of the contents. To further aid in moisture retention, a towel 70 is provided inside enclosure 14, see FIG. 10. The towel 70 can be moistened before resealing enclosure 14 to help keep the contents fresh and moist.

Figure 11:
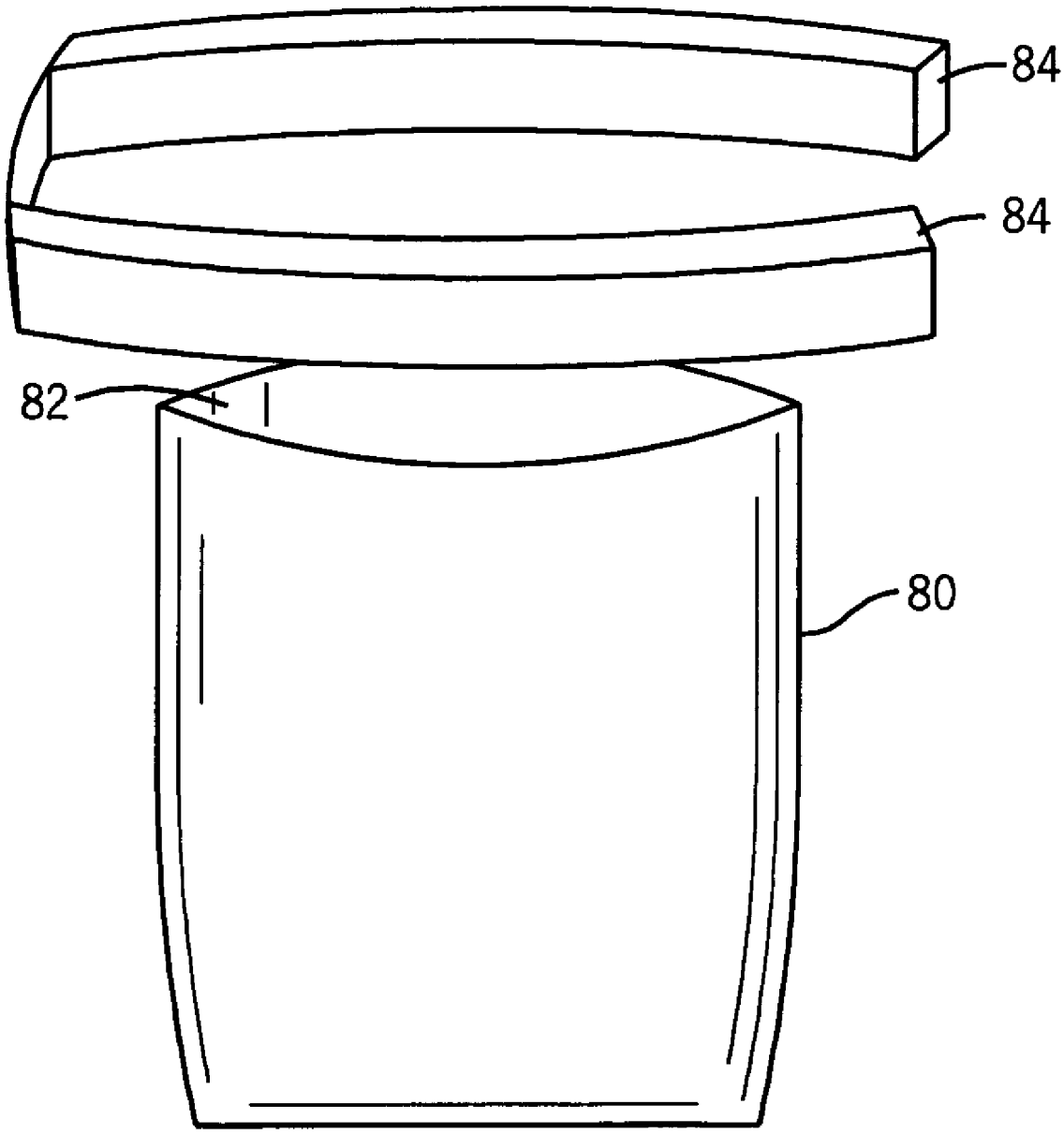
FIG. 11 illustrates magnetic strips sealing the package.

FIG. 11 shows package 80 with end 82. Package 80 contains food products as described for package 10, or other household and commercial products. Once package 80 is opened and a portion of the contents are used, two magnetic strips 84 can be used to reseal package 80. The magnetic poles of the strips are oriented to attract one another. The two magnetic strips 84 are positioned one on each side of package 80. When the two magnetic strips are brought together, the magnetic attraction seals package 80. The two magnetic strips 84 can be attached or hinged on one end, provided their magnetic poles are oriented to attract through the material of package 80 and seal its contents.

While one or more embodiments of the present invention have been illustrated in detail, the skilled artisan will appreciate that modifications and adaptations to those embodiments may be made without departing from the scope of the present invention as set forth in the following claims.

What is claimed is:

1. An enclosure for resealing a package, comprising:

a body of formable material having an open end and a closeable end, the body of formable material having slits on first and second opposite sides for expanding an area of the open end, wherein an adhesive strip on the first side is secured to the package and the second side is folded over the first side;

the adhesive strip disposed on the open end of the body of formable material, wherein the adhesive strip is adapted for securing to the package;

a resealing mechanism disposed on the closeable end of the body of formable material for resealing the package; and adhesive strips which extend beyond the slits in the body of formable material for securing the second side of the body of formable material to the first side of the body of formable material.

2. An enclosure for resealing a package, comprising:

a body of formable material having an open end and a closeable end, the open end having an area substantially larger than the package to accommodate a variety of package sizes;

an adhesive strip disposed around the open end of the body of formable material, wherein given the larger area of the open end than the package a first portion of the adhesive strip adheres to the package and a second portion of the adhesive strip adheres to itself;

a resealing mechanism formed on the closeable end of the body of formable material for resealing the package, the resealing mechanism including, (a) a lip and groove along the closeable end, and (b) a locking mechanism for inserting the lip into the groove to reseal the enclosure, wherein the resealing mechanism slides across the closeable end of the enclosure to allow the enclosure to be repeatedly opened and closed; and a towel disposed within the enclosure.

3. An enclosure for resealing a package, comprising:

an expandable body having an open end and a closeable end, the body having first and second opposite sides, wherein an adhesive strip on the first side is secured to the package and the second side is folded over the first side;

a holding mechanism disposed on the open end of the expandable body for contacting around the perimeter of the package;

a closing mechanism disposed on the closeable end of the expandable body for closing the enclosure; and adhesive strips which extend beyond the slits in the body for securing the second side of the body to the first side of the body.

4. An enclosure for resealing a package, comprising:

a body having an open end and a closeable end, the open end having an area substantially larger than the package to accommodate a variety of package sizes;

a holding mechanism disposed on the open end of the body for contacting around the perimeter of the package, the holding mechanism including an adhesive strip around the open end of the enclosure, wherein given the larger area of the open end than the package a first portion of the adhesive strip adheres to the package and a second portion of the adhesive strip adheres to itself;

a closing mechanism formed on the closeable end of the body for closing the enclosure, the closing mechanism including, (a) a lip and groove along the closeable end, and (b) a locking mechanism for inserting the lip into the groove to reseal the enclosure, wherein the closing mechanism slides across the closeable end of the enclosure to allow the enclosure to be repeatedly opened and closed; and a towel disposed within the enclosure.

5. A method of making an enclosure for sealing a package, comprising:

providing a body having an open end and a closeable end;

providing a holding mechanism along the open end of the body for contacting around the perimeter of the package;

providing a closure mechanism on the closeable end of the body for closing the enclosure;

providing slits in the body on opposite sides for expanding an area of the open end; and adhesive strips which extend beyond the slits in the body for securing the second side of the body to the first side of the body.

6. An apparatus for sealing a package, comprising:

an enclosure having an open end and a closeable end, the enclosure having slits on first and second opposite sides for expanding an area of the open end, wherein an adhesive strip on the first side is secured to the package and the second side is folded over the first side;

the adhesive strip disposed on the open end of the enclosure;

a closing mechanism disposed on the closeable end of the enclosure; and adhesive strips which extend beyond the slits in the enclosure for securing the second side of the enclosure to the first side of the enclosure.

* * * * *